US005452630A

United States Patent [19]

Haas et al.

[11] Patent Number: 5,452,630

[45] Date of Patent: Sep. 26, 1995

[54] SCREW GUN WITH A FEEDER FOR A SCREW SUPPLY BELT

[75] Inventors: Günter Haas; Wolfgang Ramin, both of Nürtingen; Gerhard Farian, Grossbettlingen, all of Germany

[73] Assignee: Karl M. Reich Maschinenfabrik GmbH, Nuertingen, Germany

[21] Appl. No.: 236,392

[22] Filed: May 2, 1994

[30] Foreign Application Priority Data

May 8, 1993 [DE] Germany ..... 43 15 403.4

[51] Int. Cl.[6] ..... B25B 23/06

[52] U.S. Cl. ..... 81/434; 81/435

[58] Field of Search ..... 81/57.37, 433, 81/434, 435

[56] References Cited

U.S. PATENT DOCUMENTS

| | | | |
|---|---|---|---|
| 4,062,389 | 12/1977 | Lejdegard | 81/434 |
| 4,146,071 | 3/1979 | Mueller et al. . | |
| 4,517,863 | 5/1985 | Ishikawa | 81/434 |
| 4,674,367 | 6/1987 | Aab et al. | 81/57.37 |
| 5,144,870 | 9/1992 | Nick | 81/434 |
| 5,231,902 | 8/1993 | Uno et al. | 81/57.37 X |

*Primary Examiner*—D. S. Meislin
*Attorney, Agent, or Firm*—W. G. Fasse; W. F. Fasse

[57] ABSTRACT

An automatic screw driving gun has a belt feeder mechanism (1) for advancing a screw supply belt (2) through a feeder housing (6) in response to the rotation of a screw drive shaft or blade (11, 28). The belt feeder mechanism (1) has a feeder lever (12) coupled to the rotating screw drive blade (11, 28) through a coupling device including a rocker lever (16) and a toggle lever (18) for a stepwise advance of the belt (4) through the feeder housing perpendicularly to the screw drive shaft. A cam driven by the screw drive shaft advances the feeder lever with each blade rotation whereby the power of the drive motor is used for the belt advance thereby relieving the operator.

8 Claims, 2 Drawing Sheets

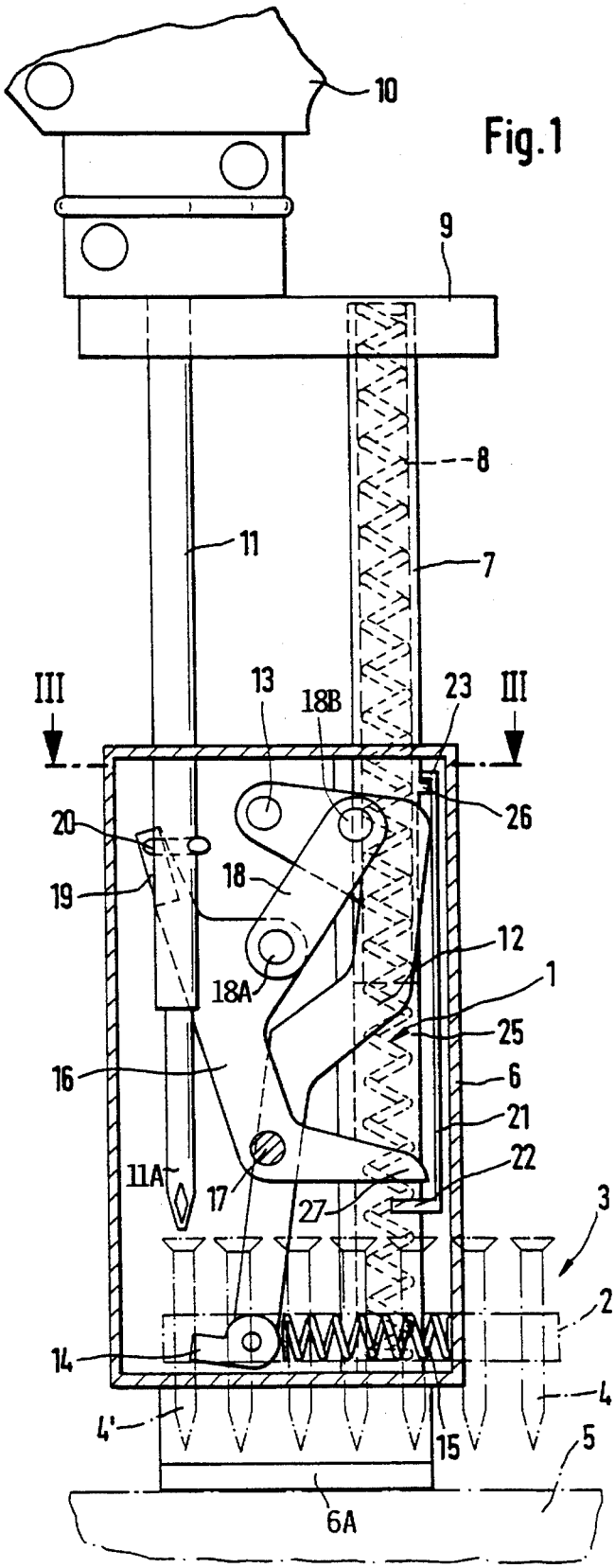
Fig. 1
Fig. 2
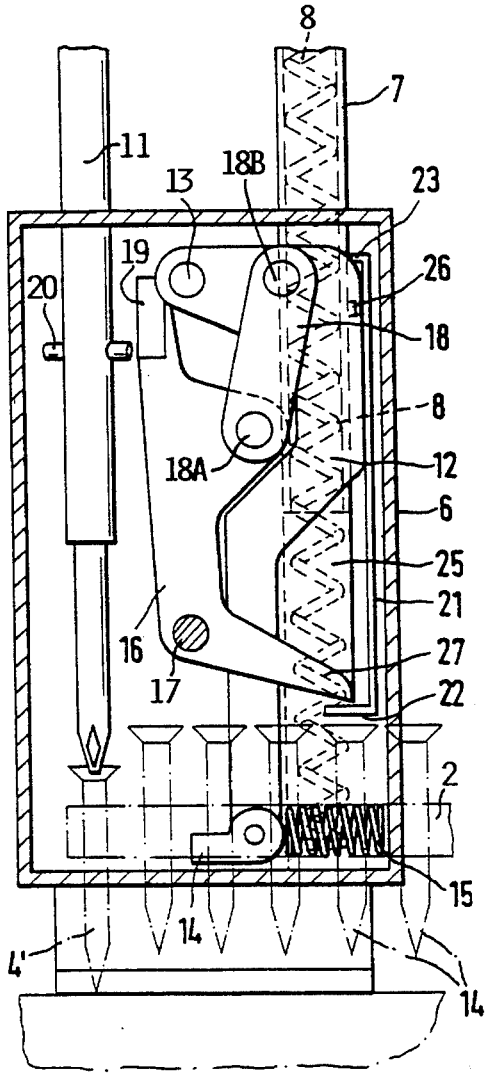

Fig.4
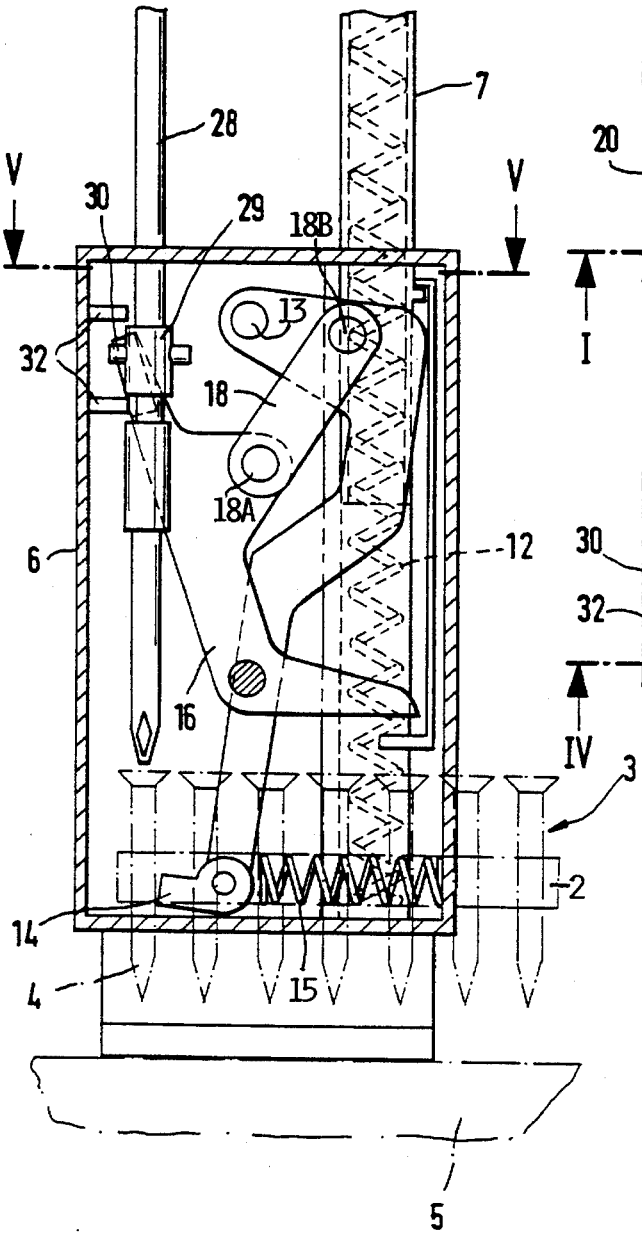
Fig.3
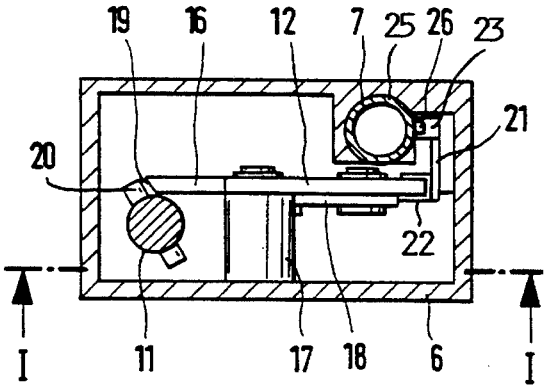
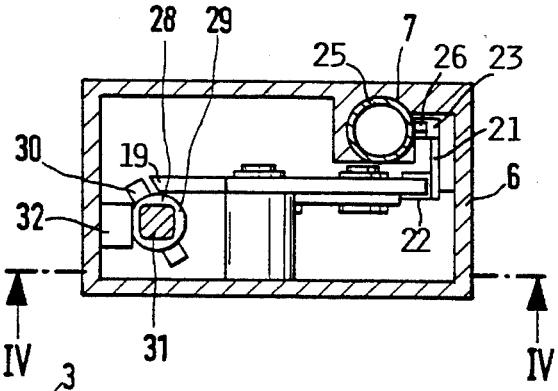
Fig.5

SCREW GUN WITH A FEEDER FOR A SCREW SUPPLY BELT

FIELD OF THE INVENTION

The invention relates to a screw gun with a feeder for a screw supply belt passing through a feeder housing. A drive motor for driving a screwdriver blade or shaft is mounted on the feeder housing so that the motor can be slidably displaced relative to the housing when a foot of the housing is pressed against a work piece for driving a screw into the work piece.

BACKGROUND INFORMATION

German Patent Publication DE-OS 2,641,828 (Müller et al.) published on Mar. 23, 1978, corresponding to U.S. Pat. No. 4,146,091 (Müller et al) issued Mar. 27, 1979, discloses a screw gun of the type described above. Such screw guns use screws that are assembled along a belt which is held in a magazine. The screw holding belt is made of a synthetic material from which the screws are individually ripped by the driving force of the driver blade. When driving a screw, the operator must push the drive motor with a guide frame or support body against the work piece, whereby the support body remains stationary relative to the work piece and the motor and driver blade are displaced toward the work piece guided by the support body.

In operating the known gun, the operator must overcome the force of two springs when he pushes the drive motor and the blade downwardly for the driving of a screw. One spring is a return or reset spring that aids in the returning of the drive motor and driver blade into a starting or rest position. The other spring is a belt feeder spring that operates the feed advance of the screw belt. The feed advance spring is cocked with each downward movement of the drive motor and driver blade. When the motor and blade are lifted again into a starting or rest position the cocked belt feeder spring is released thereby advancing the screw belt in a direction toward a position in which the next screw in the belt is in axial alignment with the driver shaft or blade. The just described apparatus works very satisfactorily but leaves room for improvement with regard to reducing the force that must be exerted by the operator so as to avoid tiring, especially when prolonged use of the screw gun is necessary.

OBJECTS OF THE INVENTION

In view of the above it is the aim of the invention to achieve the following objects singly or in combination:

- to construct a screw gun of the type described in such a way that the force to be exerted by the operator of the screw gun is reduced so as to make the operation simpler and less tiring;
- to use the driver motor power for the feed advance of the screw supply belt; and
- to provide a screw driver gun with a simple mechanism that will assure its safe function at all times including the safe return of the drive motor and blade into the starting position.

SUMMARY OF THE INVENTION

A screw gun according to the invention is characterized by the combination of the following features. A feeder housing forming a support body carries and has mounted therein for axial and rotational movement a screw drive shaft driven by a motor which itself is mounted on the feeder housing for axial displacement with the aid of a guide bushing. A belt feeder mechanism is mounted in the feeder housing for advancing a screw supply belt through the feeder housing in response to the operation or movement of the drive shaft. The mounting is such, that the motor and the screw drive shaft can be axially displaced relative to the feeder housing when the latter rests with a foot against a work piece. A belt guide channel in the feeder housing extends perpendicularly to the screw drive shaft. The belt feeder mechanism includes levers for feeding the screw supply belt through the feeder housing perpendicularly to the axial direction of the screw drive shaft. A releasable coupling device connects the belt feeder mechanism to the screw drive shaft for advancing the screw supply belt in response to a rotation of the screw drive shaft thereby avoiding the need for the operator to exert a force for cocking a spring for the feed advance of the screw supply belt.

By using the power of the drive motor for the cocking of the spring of the feed advance mechanism for the screw supply belt the operator is substantially relieved, because it is no longer necessary to overcome the biasing forces of two springs. This improvement which derives the feed advance power from the rotation of the screw drive shaft is accomplished with a simple lever mechanism temporarily coupled to the rotation of the drive shaft through a coupling device, which itself is also basically a cam driven rocker lever, preferably including also a toggle lever, whereby the cam is operated by the drive shaft. In a further embodiment, the cam is part of a sleeve that is axially shiftable on the driver blade. The arrangement is such, that the cam carrying sleeve is always in the same position relative to the feeder housing and thus to the levers of the feeder mechanism, so that a safe function is assured at all times including the return movement of the driver blade or shaft and the drive motor relative to the feeder housing, whereby that return movement is caused by a biasing spring, preferably mounted inside a guide sleeve.

BRIEF DESCRIPTION OF THE DRAWINGS

In order that the invention may be clearly understood, it will now be described, by way of example, with reference to the accompanying drawings, wherein:

FIG. 1 is a side view, partially in section, of a screw gun according to the invention with the components shown in their rest or starting position;

FIG. 2 is a view similar to that of FIG. 1, however showing the components in the operating condition with the springs cocked;

FIG. 3 is a sectional view along section lines III—III in FIG. 1;

FIG. 4 is a view similar to that of FIG. 1 but showing a modified coupling device for the feeder mechanism of the screw supply belt; and FIG. 5 is a view similar to that of FIG. 3, however along section line V—V in FIG. 4.

DETAILED DESCRIPTION OF PREFERRED EXAMPLE EMBODIMENTS AND OF THE BEST MODE OF THE INVENTION

FIG. 1 shows the screw gun according to the invention in a rest position prior to advancing a drive motor 10 downwardly for driving a screw 4' into a work piece 5 by the rotation of a screw drive shaft 11 which is mounted for axial and rotational movement in a feeder housing 6 having a foot 6A for resting the screw gun on the work piece 5. The screw 4' is the leading screw in a screw supply belt 2 holding a plurality of screws 4. The belt 2 and the screws 4 together form a screw supply 3. The leading screw 4' is axially aligned with the screw drive shaft 11 which is preferably provided with an exchangeable driver tip 11A. A screw feed advance mechanism 1 is mounted in the feeder housing 6 as will be described in more detail below.

The feeder housing 6 forms a support body for the drive motor 10. For this purpose the motor 10 is mounted on a flange 9, which in turn is mounted to a guide bushing 7, which itself is guided for axial movement relative to the feeder housing 6 in a bore 25 in the feeder housing 6 against the force of a reset first spring 8 which biases the flange 9 away from the feeder housing 6. The spring 8 is compressed when the motor 10 with its flange 9 is pressed downwardly by the operator for driving a screw 4' into the work piece 5 as shown in FIG. 2.

The screw drive shaft 11 which passes rotatably through the flange 9 is mounted in the feeder housing 6 for rotation and axial movement as mentioned above. The shaft 11 and the guide sleeve 7 move in unison into and out of the feeder housing 6.

The feed advance mechanism 1 includes a feeder lever 12 mounted on a journal 13 held in place in the housing 6, whereby the lever 12 is tiltable clockwise and counterclockwise as will described below. The lower free end of the lever 12 is provided with a feeder finger 14 for advancing the belt 2 through the feeder housing 6. The lower free end of the feeder lever 12 is biased by a cocking second spring 15 arranged horizontally in the housing 6. The springs 8 and 15 are arranged at right angles relative to each other, whereby the operator does not need to exert any force for the cocking of the spring 15, since according to the invention the spring 15 is cocked into the position shown in FIG. 2 by the rotational power of the screw drive shaft 11. For this purpose, the cocking or feed advance lever 12 is temporarily coupled to the drive shaft 11 depending on the axial position of the drive shaft 11 by a coupling device including a rocker lever 16 and preferably also a toggle lever 18.

The rocker lever 16 is journalled on a journal shaft 17 mounted in the housing 6. The coupling device preferably includes the toggle lever 18 pivoted to the rocker lever 16 at 18A and to the feeder lever 12 at 18B. The upper end of the rocker lever 16 has a slanted surface 19 adapted for engagement by a cam 20 secured to the drive shaft 11. As shown in FIG. 2, the cam 20 has just left the slanted engagement surface 19 as the shaft 11 is pressed further downwardly to drive the screw 4' into the work piece 5. However, at this point the rocker lever 16 and thus the toggle lever 18 have assumed such a position in response to the previous cam engagement that the spring 15 remains cocked until the shaft 11 and thus the guide sleeves 7 are moved upwardly again, whereby the spring 15 will be released, thereby advancing the belt 2 by one step to bring the next screw into axial alignment with the shaft 11.

FIG. 3 shows how the cam 20, which may be a pin rigidly passing through the shaft 11 is positioned relative to the slanted surface 19 of the rocker lever 16 when the cam 20 begins to engage the surface 19 during downward movement of the shaft 11.

When the screw driving is completed, the operator releases the pressure, whereby the spring 8 moves the sleeve 7 upwardly, thereby lifting a release rod 21 by engaging an angled upper end 23 with a cam 26. The release rod 21 is slidably mounted in the housing 6 and also has an angled lower end 22 for engaging a right hand free end 27 of the rocker lever 16.

The operation of the present screw gun will now be described in further detail starting with FIG. 1. When the drive motor 10 is switched on, the shaft 11 begins to rotate and the cam 20 rotating with the shaft 11 contacts the surface 19 of the rocker lever 16, thereby bringing the coupling device with the rocker lever 16 and the toggle lever 18 into the position shown in FIG. 2, whereby the spring 15 is simultaneously cocked, as mentioned above. The shaft 11 is now free to be moved further downwardly for the completion of the driving of a screw. The rocker lever 16 and toggle lever 18 are so dimensioned and arranged that the position shown in FIG. 2 will be retained, even though the cam 20 has disengaged from the surface 19. In other words, the toggle lever 18 is passed through its dead point so as to be able to keep the spring 15 cocked as shown in FIG. 2 until the driving of the driving of the screw 4' is completed. At this time the feeder finger 14 reaches between two screws 4 following the screw 4' that is being driven.

Upon completion of the screw driving, the motor 10 and the guide sleeve 7 are lifted by the reset spring 8. Prior to reaching the upper rest position, the cam 26 engages the upper angled end 23 of the release rod 21, thereby lifting the free arm 27 of the rocker lever 16 by the engagement with the lower angled end 22, thereby turning the rocker lever 16 about its journal 17 in the counterclockwise direction to bring the toggle lever 18 out of the dead position. As a result of this movement, the feeder finger 14 under the release force of the spring 15 advances the next screw 4 into axial alignment with the shaft 11, as shown in the rest position of FIG. 1, whereby the screw gun is ready for the next driving operation.

FIGS. 4 and 5 illustrate a further embodiment of the invention, wherein the screw drive shaft 28 carries a sleeve 29 provided with a cam pin 30. The shaft 28 can axially pass through the sleeve 29. However, a shaft section is provided with a square cross section engaging a square bore in the sleeve 29 so that the sleeve is rotated with the shaft 28 even as the shaft 28 passes axially through the sleeve 29. Two stops 32 are secured to the inner wall of the housing 6. These stops 32 limit the upward and downward axial movement of the sleeve 29. Thus, the cam 30 remains in a position for engaging the surface 19 of the rocker lever 16, so that the function of the embodiment of FIGS. 4 and 5 is the same as that described above with reference to FIGS. 1 to 3.

Although the invention has been described with reference to specific example embodiments, it will be appreciated that it is intended to cover all modifications and equivalents within the scope of the appended claims.

What is claimed is:

1. A screw gun comprising a feeder housing (6) forming a support body, a screw drive shaft (11) mounted for axial and rotational movement in said feeder housing (6), a belt feeder mechanism (1, 12, 13, 14) mounted in said feeder housing for advancing a screw supply belt through said feeder housing, a drive motor (10) for driving said screw drive shaft (11), means (7, 8, 9) including a guide member (7) mounting said drive motor (10) on said feeder housing for displacing said drive motor (10) and said screw drive shaft (11) axially relative to said feeder housing, a belt guide channel in said feeder housing (6) extending perpendicularly to said screw drive shaft (11), said belt feeder mechanism comprising feeder levers (12, 14) for feeding said screw supply belt through said feeder housing perpendicularly to said screw drive shaft, and a coupling device (16, 18, 19, 20)

for temporarily connecting said belt feeder mechanism to said screw drive shaft (11) for advancing said screw supply belt in response to a rotation of said screw drive shaft.

2. The screw gun of claim 1, wherein said coupling device comprises a rocker lever (16) connected to said belt feeder mechanism and a biasing spring (15) for biasing said feeder mechanism, said coupling device comprising a cam (20, 30) connected to said screw drive shaft for operating said feeder mechanism through said rocker lever (16) by said screw drive shaft against the bias of said biasing spring (15).

3. The screw gun of claim 2, wherein said coupling device further comprises a toggle lever (18) arranged between said belt feeder mechanism and said rocker lever (16) of said coupling device for keeping said biasing spring (15) cocked until release.

4. The screw gun of claim 3, further comprising a release member (21) positioned for driving said rocker lever (16) back into its rest position, said release member (21) being responsive to a motion of said guide member (7) forming part of said mounting means, said release member (21) cooperating with said rocker lever (16) in response to an axial movement of said guide member.

5. The screw gun of claim 1, wherein said coupling device comprises a cam sleeve (29) carrying a cam (30), said cam sleeve being slidably mounted on said screw drive shaft, said cam sleeve cooperating with said feeder mechanism in response to rotation of said screw drive shaft.

6. The screw gun of claim 1, wherein said mounting means comprise a reset first spring (8) guided by said guide member (7), said reset first spring (8) biasing said feeder housing (6) away from said drive motor, and wherein said belt feeder mechanism comprises a belt feeder second spring (15) for advancing said screw supply belt, said first and second springs being arranged at a right angle relative to each other.

7. The screw gun of claim 6, wherein said guide member (7) is a guide bushing, said reset first spring (8) being arranged inside said guide bushing, whereby the guide bushing guides said first spring (8) and is itself guided in a bore (25) in said feeder housing.

8. The screw gun of claim 7, further comprising a release member (21) mounted in said feeder housing for back and forth movement with said guide bushing, said coupling device comprising a rocker lever (16) mounted on a journal (17) in said feeder housing for a rocking movement, said release member (21) cooperating with said rocker lever (16) for engaging and disengaging said coupling device with and from a rotation of said screw drive shaft in response to a respective axial position of said guide bushing (7).

* * * * *